US006631536B2

(12) United States Patent
Feldmeyer

(10) Patent No.: US 6,631,536 B2
(45) Date of Patent: Oct. 14, 2003

(54) DEVICE HANDLE

(75) Inventor: Mark D. Feldmeyer, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 133 days.

(21) Appl. No.: 09/796,710

(22) Filed: Mar. 2, 2001

(65) Prior Publication Data

US 2002/0121004 A1 Sep. 5, 2002

(51) Int. Cl.[7] ..... G06F 1/16; A45C 13/22; A45C 13/26

(52) U.S. Cl. ..... 16/422; 361/685

(58) Field of Search ..... 16/422; 361/685, 361/727; 312/119, 122

(56) References Cited

U.S. PATENT DOCUMENTS 3,923,191 A * 12/1975 Johnson ..... 220/760
4,393,540 A * 7/1983 Yamamoto et al. ..... 16/422
5,654,873 A * 8/1997 Smithson et al. ..... 361/685
5,791,753 A * 8/1998 Paquin ..... 312/332.1
5,978,212 A * 11/1999 Boulay et al. ..... 361/685
6,222,736 B1 * 4/2001 Sim et al. ..... 361/727
6,272,005 B1 * 8/2001 Jensen et al. ..... 361/680
6,374,460 B1 * 4/2002 Edevold et al. ..... 16/422
6,407,913 B1 * 6/2002 Peachey et al. ..... 361/685
6,490,153 B1 * 12/2002 Casebolt et al. ..... 361/685

OTHER PUBLICATIONS

Digital Image of an IBM Netfinity 5600 Microprocessor Assembly.
Digital Image of a Foxconn Cable Connector Release.

* cited by examiner

*Primary Examiner*—Anthony Knight
*Assistant Examiner*—William D Hutton, Jr.

(57) ABSTRACT

A handle for removing, carrying or otherwise manipulating a device is disclosed. The handle includes features that allow it to engage the mounting rails on other mounting features associated with the device. The handle is constructed such that when properly installed, pulling the handle causes the mounting rails to move both in the direction of the pulling force and perpendicularly thereto, toward each other. This allows the mounting rails to clear security features of the larger assembly, device bay, or housing in which the device is mounted or rests. The handle may be constructed so that it is removable, either with or without removal of the mounting assemblies or mounting rails. Further, the handle may be constructed to allow a user access to the front of a device while the handle is installed.

2 Claims, 4 Drawing Sheets

DEVICE HANDLE

TECHNICAL FIELD

The invention relates to straps and handles. In one embodiment, the invention relates to a handle for removing and carrying devices with mounting rails such as electronic mass storage devices.

BACKGROUND ART

Electronic devices are often constructed so that various components may be removed and replaced within a larger unit to suit a user's preferences. A popular method of detachably mounting these devices is to employ some mounting assembly, such as a rail on either side of the device. In methods of this type, the larger unit is typically equipped with features complementary to the mounting assembly such that a device may be detachably affixed to the larger unit. A known system with such features uses mounting rails attached to either side of the device with slots complementary to the mounting rails so that the slots accept the mounting rails and the removable device slides into or out of the larger assembly on the mounting rails. These mounting rails may extend beyond the particular unit to which they are attached. In such instances, the mounting rail ends, which extend beyond the device, may be configured to secure the device in place within a larger assembly. Alternatively, the rails may include other features to serve this purpose or a variety of other functions.

While such structures are not without merit, they do not include the advantages of the present invention. These previously known structures may provide adequate security against a device accidentally or inadvertently sliding out of a larger unit, however, it is often quite difficult to remove such a device. The security function served by the combination of the mounting rails, the complementary slots into which the mounting rails slide, the end features of the mounting rails, and the complementary features of the larger assembly or housing, which engage the end features of the mounting rails, make removal of the devices difficult.

Previously known solutions relied on small finger grab features on the end of each rail. A user would need to pinch, using the thumb and index or little finger, to manipulate the grab features and exert enough force to allow the user to pull the device out of the device bay. Successful removal of the device would usually require a user to grab each rail with the thumb and index finger and pull the device out of the device bay. Once the securing portion of the rail has cleared the complimentary construction on the device bay or housing through release of the finger grab feature and exertion of sufficient forward movement, the user may grab the device itself and then fully extract it from the device bay by pulling on the device.

In order to remove such a device, a user must manipulate the mounting rail or the attachment thereto on either side of the device so that it clears the complementary features of the larger assembly or housing which engages the end features of the mounting rails. A user would then proceed with this action simultaneously on both sides of the device and at the same time pull the device away from the larger assembly so as to remove the device from the larger assembly. This would ensure even removal of the device and avoid the device jamming or otherwise becoming stuck between the mounting rails or within the larger assembly.

Preventing such jamming is important, as further attempts to remove a device once it is stuck often result in damage to the device, its mounting assembly or the device bay. Users often exert excessive or otherwise inappropriate force upon the stuck device as well as the larger assembly it is meant to fit within. In the event that a device is stuck within the device bay or larger assembly, the user is typically left with little to grasp in order to exert sufficient pulling force so as to properly remove the device from the device bay or larger assembly. In certain instances, the user may damage the finger grab features at the end of the mounting rails, or the mounting rails themselves, in removing the device from the device bay. In sum, successful removal of devices using known apparatus typically requires that a user employ both hands and a certain amount of dexterity and strength in order to remove the device from the device bay.

As will become apparent from the following descriptions and drawings, none of the previously known devices include the advantages of the present invention. The present invention enables relatively easy removal of devices from device bays as well as a means for carrying the device once it is so removed without suffering from the drawbacks and difficulties associated with previously known devices of this type.

SUMMARY OF INVENTION

The present invention relates to a handle which detachably engages one of multiple mounting rails on other mounting assemblies mounted to a removable device. In a preferred embodiment, the handle is constructed to engage two mounting rails which are mounted to opposite sides of the device. When the handle is pulled away from the device, the ends of the handle pull the mounting rails toward each other so that the mounting rails may clear the assembly to which the device is mounted, thereby releasing the device. Continued pulling on the handle causes the entire device to be removed from the device bay. Alternatively, the handle may be used to carry the device when the device is removed entirely from the device bay. The handle allows a user with small hands or minimal finger strength or minimal dexterity or any combination of the foregoing to remove a device with one hand and easily carry and manipulate the device.

Preferably, each handle includes a band portion connecting two end portions where the band portion is an elongated component that is characteristically at least slightly flexible and each end portion is configured to detachably engage one of two separate mounting rails or other mounting devices mounted on the device. The mounting devices are configured to hold the device in place once it is installed in a larger assembly, unit, or as part of a rack system. In a preferred embodiment, the band portion is configured to detachably engage mounting rails mounted to opposite sides of the device such that each end portion is attached to the opposite end of the band portion. The handle is preferably constructed of a flexible yet resilient material such as plastic or rubber and the handle is such that when the handle is pulled away from the device it pulls the mounting rails on opposite sides of the device laterally towards each other.

Additional advantages and novel features of the invention will be set forth in part in the description which follows and in part will become apparent to those skilled in the art upon examination of the following or may be appreciated by practice of the invention.

DETAILED DESCRIPTION OF PREFERRED EMBODIMENTS

For simplicity and illustrative purposes, the principles of the present invention are described by referring mainly to various exemplary embodiments thereof. Although the preferred embodiment of the invention may be practiced with an electronic device, one of ordinary skill in the art will readily recognize that the same principles are equally applicable to, and can be implemented in, a variety of other systems, and that any such variation would be within the modifications that do not depart from the true spirit and scope of the present invention. Before explaining the disclosed embodiments of the present invention in detail, it is to be understood that the invention is not limited in its application to the details of any particular arrangement shown, since the invention is capable of other embodiments. Also, the terminology used herein is for the purpose of description and not of limitation.

Figure 1:
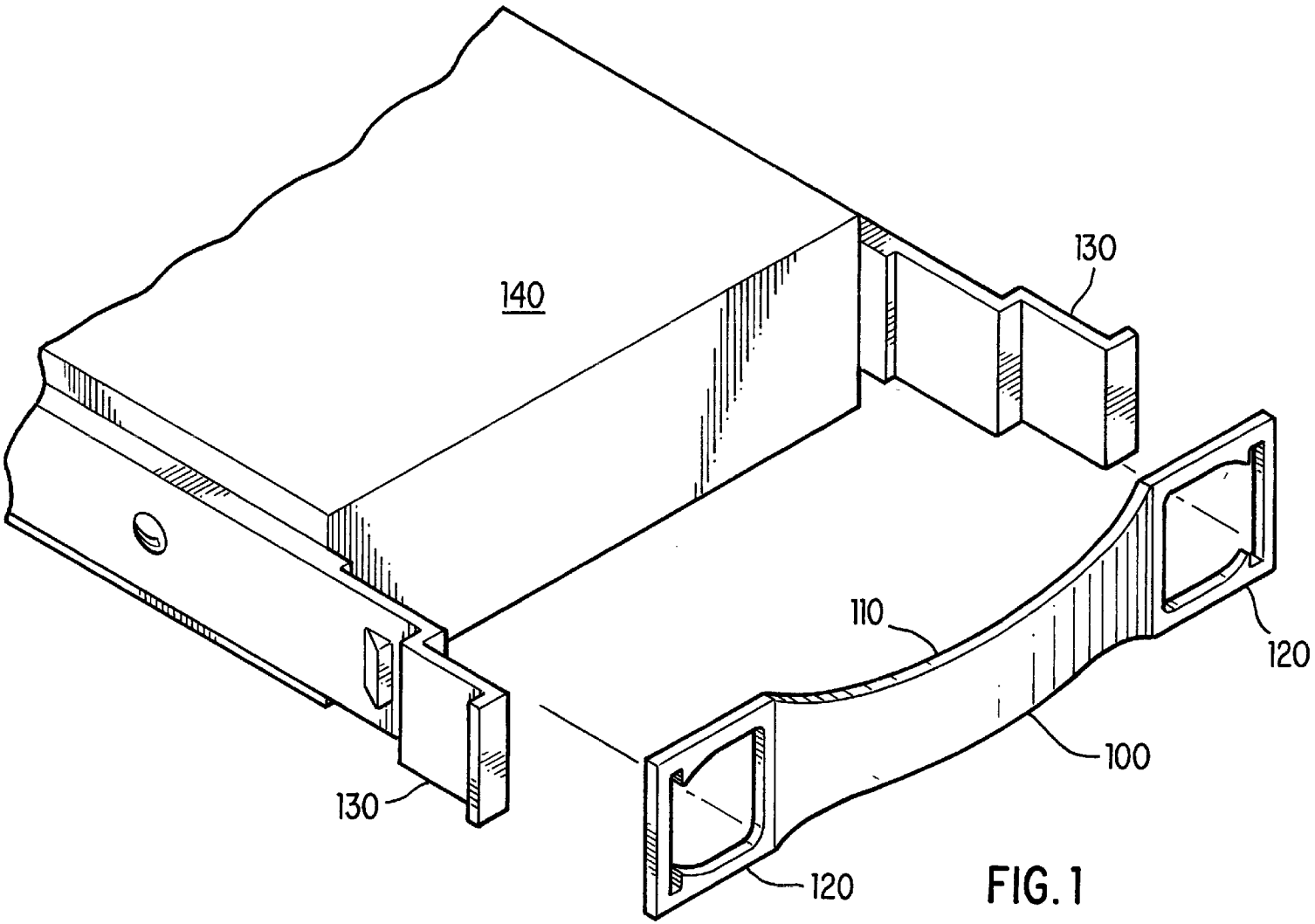
FIG. 1 depicts an elevated, lateral perspective view of one embodiment of the invention.

FIG. 1 shows an elevated perspective view of one embodiment of the invention. A handle 100 is depicted as having a band portion 110 and two end portions 120. The band portion 110 is preferably an elongated component, being generally shaped like a strap or a belt, though in certain embodiments the band portion 110 may more closely resemble a cord or a rope. Each end portion 120 is attached to or is continuous with the band portion 110. Further, each end portion 120 is configured to detachably engage one of two separate mounting rails 130 attached to the device 140. Alternatively, a variety of other mounting assemblies are suitable for use with the inventive concepts disclosed herein.

The mounting rails 130 are attached to the device 140 and the mounting rails 130 are constructed such that when the device 140 is simply pulled away from the device bay, the mounting rails 130 do not clear some feature on the device bay, or on the unit housing, or otherwise on the assembly. Thus, to remove the device 140, the mounting rails 130 must first be moved toward each other so that they clear the feature on the device bay, or the unit housing, or the assembly.

Preferably, each end portion 120 is attached at opposite ends of the band portion 110. The band portion 110 is preferably constructed of a material that is characteristically at least slightly flexible and at the same time resilient. Suitable materials include any of the family of compounds collectively referred to as plastics or rubbers, or other compounds having suitable characteristics including flexibility and resiliency. In a preferred embodiment, the band portion 110, as well as both end portions 120, are constructed from acrylonitrile butadiene styrene, however, one skilled in the art would appreciate that these components could be constructed from a wide variety of different materials. While the band portion 110 may be constructed from a wide variety of materials, the material should be selected such that the band is of sufficient durability to withstand the pulling and other forces exerted by users in removing and carrying the device 140 to which the handle 100 is attached. Additionally, a user may find it desirable to employ different materials between and among the end portions 120 and the band portion 110.

Figure 2:
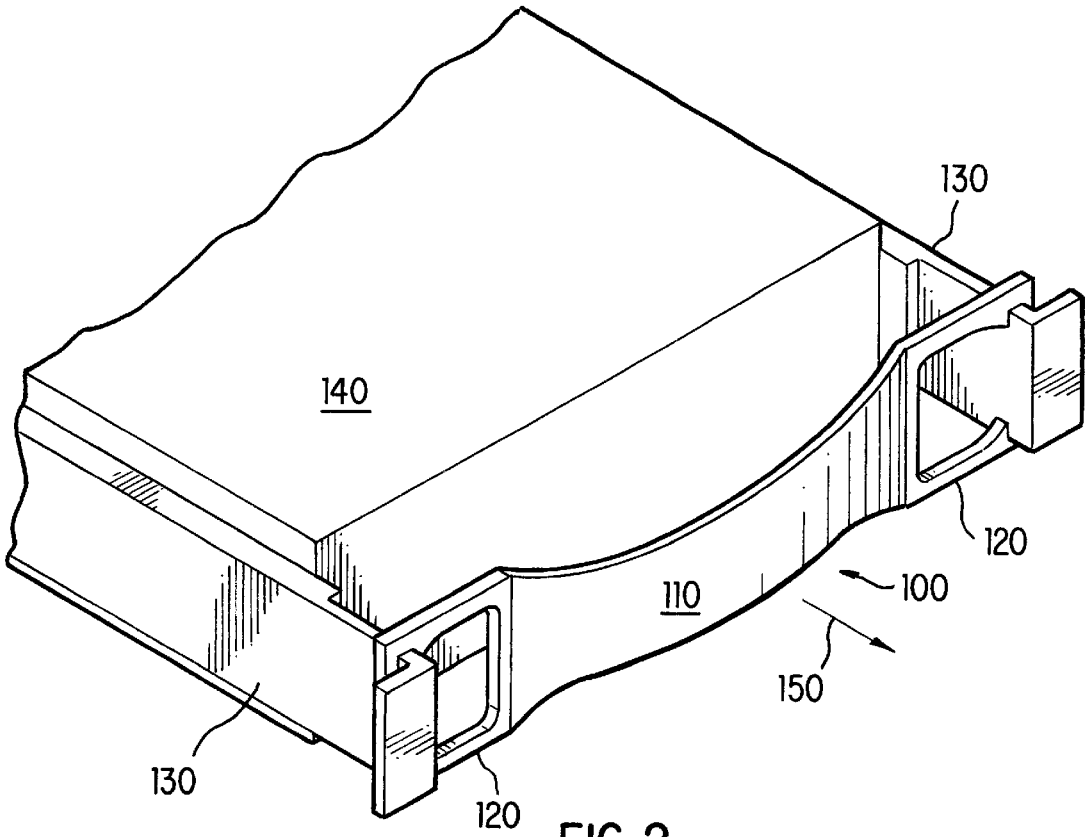
FIG. 2 depicts another perspective view of an embodiment similar to that shown in FIG. 1, with a handle installed on a device.

In certain embodiments, the selection of materials for the handle 100 becomes important as these materials ensure that the handle 100 will perform as desired. The handle 100 is constructed such that a user grasps the band portion 110 with his or her hand and pulls the band portion 110 away from the device 140. The exertion of this pulling force causes the band portion 110 to flex and requires that each of the end portions 120 move laterally towards one another. In this way, the handle 100 serves to redirect part of the pulling force into a force perpendicular to the pulling force and acting on each end portion 120 to substantially move the two end portions 120 toward each other. As illustrated in FIG. 2, the end portions 120 may be removably attached to a mounting assembly, preferably two mounting rails 130 such that when the end portions 120 move toward each other, they cause the mounting rails 130 to move toward each other. When a sufficient pulling force is exerted, the mounting rails 130 may move to a new position such that they are capable of clearing all of the features of the assembly or unit housing the device 140. This unique feature enables a user to remove a device 140 relatively easily with one hand, instead of having to use two hands, or struggling to remove the device 140 with one hand. This handle 100 is also preferably adapted to permit a user to carry the device 140 with relative ease.

The word device, as used throughout the present disclosure, including the claims hereof, is meant to include any device mounted or fashioned in such a way as to permit use of the present invention. More particularly, a device would use mounting rails 130 or some other mounting assemblies that require a user to pull the mounting rails 130 or other mounting features toward one another in order to release the device 140 from its device bay, housing, mounting rack, or other similar assembly. Thus, the invention will have application to a wide variety of devices, primarily those that are rack-mounted or otherwise stored or installed such that to remove the devices one must manipulate both sides of the device, at its mounting assembly.

In a preferred embodiment, a handle 100 is constructed for use in removing computer devices, including mass storage devices, such as CD-ROM devices, Digital Audio Tape devices, Digital Linear Tape devices and Digital Video Disc devices. One skilled in the art can readily appreciate that the principles of the present invention have application to a wide variety of devices. For instance, the device 140 might be employed with removable automobile stereo units, to permit quick and convenient removal of these units, as preferred by the user.

In accordance with another embodiment, each element of the handle 100 is of a minimum strength necessary to remove and to support the entire weight of the device 140, so that a user may remove the device 140 and safely carry it, without concern that the handle 100 or any part thereof might fail. As used herein, the term strength refers to that characteristic of materials such that a material will withstand normally intended uses, including, but not limited to, normal wear, without failing. Failing should be understood to include any breakage or other event after which the component or material is no longer suitable for its intended purpose.

It is to be understood for purposes of the present disclosure that while the invention is described as including multiple elements, and the invention may exist as a handle with multiple discreet elements, it may include one continuous element having one or more of the inventive features described herein. Thus, the invention encompasses handles 100 having the necessary elements whether they exist as a singular continuous unit or they are constructed from a variety of different elements, even where the elements in a single handle 100 are composed of different materials. In this respect, the handle 100 may exist as multiple continuous elements.

FIG. 2 shows an elevated perspective view of a handle 100 installed on mounting rails 130 of a device 140. As is evident from the illustration, in this embodiment, each of the end portions 120 are contiguous with the band portion 110 at opposite ends of the band portion 110. This allows each end portion 120 to engage one of the mounting rails 130 which are attached to opposite sides of the device 140. Each of the end portions 120 engage one of the mounting rails 130 in a manner that provides for a transfer of force between the handle 100 and the mounting rail 130. This includes, but is not limited to, a force which may either cause the end portions 120 and the mounting rails 130 attached thereto to move laterally towards each other, or ensure that each of the mounting rails 130 are appropriately separated from one another, or pull the mounting rails 130 and the device 140 attached thereto away from the device bay, or push the mounting rails 130 and the device 140 attached thereto into a device bay. It should be appreciated that a singular handle 100 may incorporate all of these functions in one unit.

One may also appreciate from FIG. 2 the manner in which the handle 100 redirects an outward pulling force into a perpendicular lateral force pulling each end portion 120 and the respective mounting rail 130 engaged thereto toward the other end portion 120 and the mounting rail 130 engaged to it. As the band portion 110 is pulled away from the device 140, in the direction of the arrow 150, the band portion 110 will flex, and this causes the two end portions 120 to substantially move toward each other, pulling the mounting rails 130 to which they are attached toward each other.

Another preferable feature of the embodiment depicted in FIG. 2 is the generally arc-shaped curve of the band portion 110. The band portion 110 curves towards the device 140 such that a user may easily grasp the band portion 110 when the handle 100 is installed.

Figure 3:
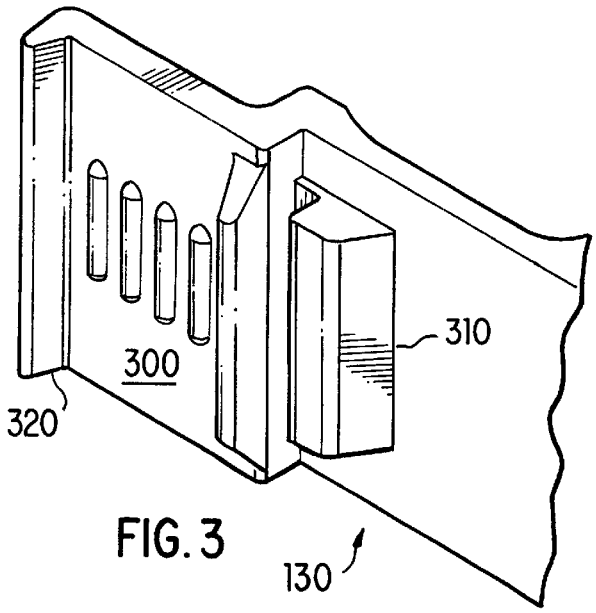
FIG. 3 depicts an enlarged perspective view of an exemplary mounting rail.

FIG. 3 depicts an elevated perspective view of the end of an exemplary mounting rail 130. The term mounting rail, as used throughout this disclosure and the claims, refers to any suitable system or assembly for mounting a device as described herein. Preferably, each mounting rail 130 includes a finger hook 320 and a snap latch having a block flange 310 and a stop flange 300. The finger hook 320 provides an abutment surface upon which the handle 100 may attach. The block flange 310 and the stop flange 300 serve to prevent a device from substantially sliding laterally along either mounting rail 130. In particular, the stop flange 300 substantially prevents the device from sliding too far into the larger assembly, while the block flange 310 substantially prevents the device from sliding out of the larger assembly. A variety of similar structures having alternate construction would operate in a similar manner and any unit constructed so as to properly engage such a structure would fall within the scope of the contemplated invention.

Figure 4:
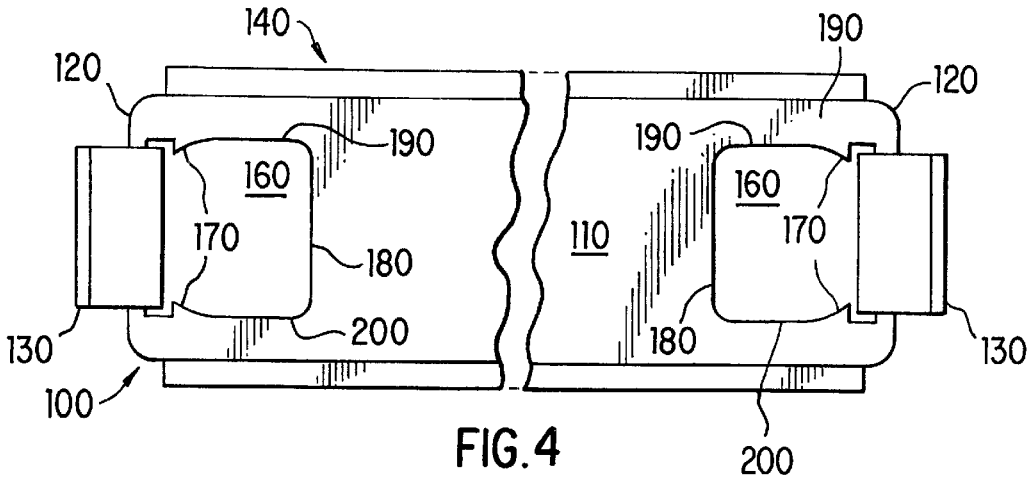
FIG. 4 depicts a front view of one embodiment of the invention, installed.

FIG. 4 shows a front view of the handle 100 install on a device. As is evident from this illustration, each of the end portions 120 are constructed such that they engage each mounting rail 130 in a way that the handle 100 may fully support the device 140 when removed from the device bay. In the arrangement shown in FIG. 4, each end portion 120 includes a portion that wraps behind or underneath part of the mounting rail 130. In this way, the handle 100 may support the device 140 that is attached to the mounting rails 130. One skilled in the art would appreciate that a variety of similar arrangements would work for the purposes of this present invention.

One may also appreciate from FIG. 4 how the end portions 120 of the handle 100 may be constructed so that the mounting rails 130 are detachably engaged therein. Specifically, each mounting rail 130 may be removed or attached to an end portion 120 as desired by a user. In use, the mounting rails 130 are inserted through holes 160 in respective end portions 120 and then fit in place over one or more placement flanges 170. The hole 160 in each end portion 120 is defined by an interior edge 180. The hole 160 is preferably of a predetermined size to ensure the mounting rails 130 will fit snugly therein. In a preferred embodiment, the placement flanges 170 are mounted laterally in approximately the same position along the top edge 190 and bottom edge 200 of the hole 160. The mounting rail 130 is inserted through the hole 160 and the position of the placement flanges 170 permits movement of the mounting rail 130 to a relatively secure position.

Figure 5:
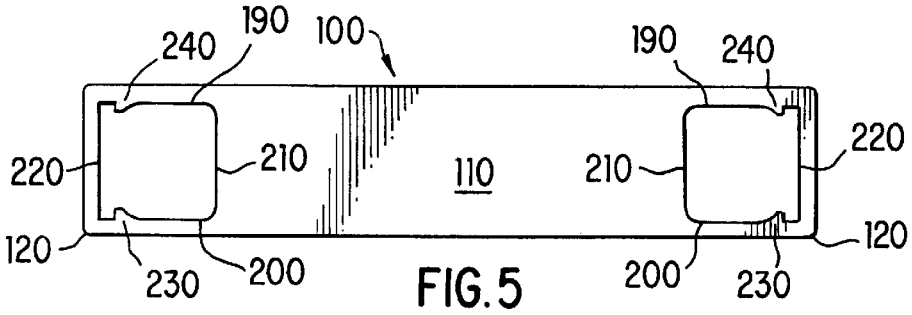
FIG. 5 depicts a front view of an embodiment of the invention in accordance with the illustration shown in FIG. 3.
Figure 6:
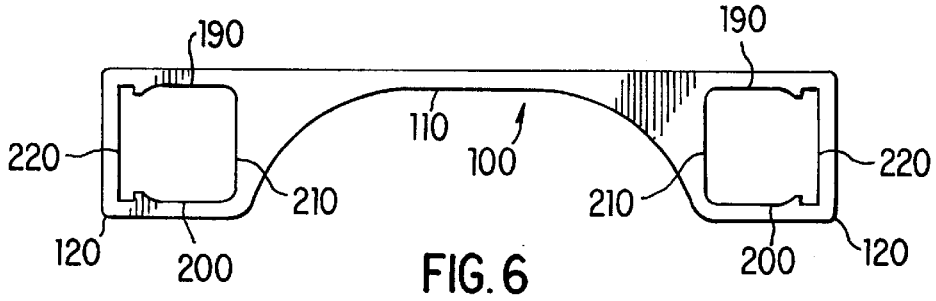
FIG. 6 depicts a front view of another embodiment of the invention.

FIGS. 5 and 6 show front views of two additional embodiments of the present invention 100. These two drawings particularly illustrate the end portions 120 and the particular shape suitable for use in the manner contemplated. With reference to FIG. 6 in particular, one may appreciate how the band portion 110 might be shaped so as to allow access to the front side of a device. This would be useful where the device includes controls or visible display devices or otherwise requires a user to access the front side of a device while the handle 100 is installed, as in the case of a CD-ROM drive.

With reference to FIG. 5, a user may prefer to forgo the ability to access the front side of a device for a handle 100 of increased size across the band portion 110. This would permit the band portion 110 to be of relatively greater strength, as may be necessary for use with devices that are heavy or are not otherwise easily removed. This size across the band portion 110 could be increased as necessary in width or in thickness or both dimensions. Should a user then require access to the front side of a device, the user may simply remove the handle 100, access the device, and replace the handle 100 as desired.

FIGS. 5 and 6 also depict the different edges that make up the interior edge 180 defining each hole 160 in the end portion 120. These different edges include a top edge 190, a bottom edge 200, an outside edge 220 and an inside edge 210. The outside edge 220 is the edge furthest from the band portion 110, while the inside edge 210 is the edge nearest to the band portion 110. FIG. 5 also depicts two placement flanges, which may be referenced as a top flange 240 or a bottom flange 230. As previously described, these flanges assist in securing a mounting rail 130 in position and are collectively referred to as placement flanges.

Figure 7:
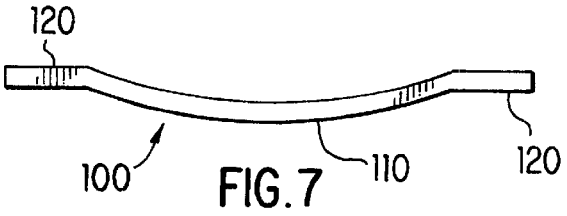
FIG. 7 depicts a top view of one embodiment of the invention.

FIG. 7 shows a top view of one embodiment of the invention 100. It can be appreciated that the curvature of the band portion 110 would enable a user to wrap his or her hands around the band portion 110 for grasping the band portion 110 and either pushing, or pulling, or carrying the device attached thereto as necessary or desired by the user. Also evident in FIG. 7 are the end portions 120, located on opposite sides of the band portion 110. The handle of this embodiment is generally arc-shaped, though many different shapes are suitable and would work within the scope of the presently contemplated invention.

Figure 8:
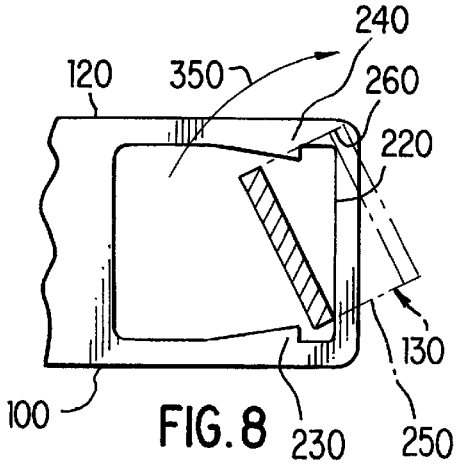
FIG. 8 illustrates a cut-away view showing the manner in which a mounting rail may be installed within the invention in accordance with an embodiment of the invention.

FIG. 8 depicts a cut-away view showing part of an embodiment of the invention and how a mounting rail 130 might be installed into the end portion 120. In this embodiment, each mounting rail 130 may be inserted into the hole 160 on an end portion 120 and then moved into a relatively secure position. The movement is preferably one of fitting the bottom edge 250 of the mounting rail 130 into the gap between the bottom flange 230 and the outer edge 220 of the hole 160. Then the top edge 260 of the mounting rail 130 may be rotated slightly toward the outer edge 220 of the hole 160, in the direction of the arrow 350, so that the top edge 260 of the mounting rail 130 fits in the gap between the top flange 240 and the outer edge 220 of the hole 160. Alternatively, the reverse order may be used, where the top edge 260 of the mounting rail 130 is first inserted and the bottom edge 250 is rotated into place secondly. In a preferred embodiment, each mounting rail 130 rests relatively snugly against the outer edge 220 of the hole 160 and is held in place there by the placement flanges 230 and 240.

Once both mounting rails 130 are engaged within the holes 160, the device (not depicted) may be removed by simply pulling on the handle 100 or installed by pushing the device (not depicted) into the device bay. This operation is relatively easily accomplished with one hand. Alternatively, the handle 100 may be used to carry the device (not depicted) when removed from the device bay.

In order to remove the handle 100, a user would disengage each of the mounting rails 130 from its respective end portion 120. This may be achieved by reversing the previously described installation steps.

Depending upon the particular embodiment used, removal of the handle may first require removal of the device from the device bay, then removal of each mounting rail or other mounting assembly, followed by removal of the mounting rail or other assembly from the handle.

Figure 9:
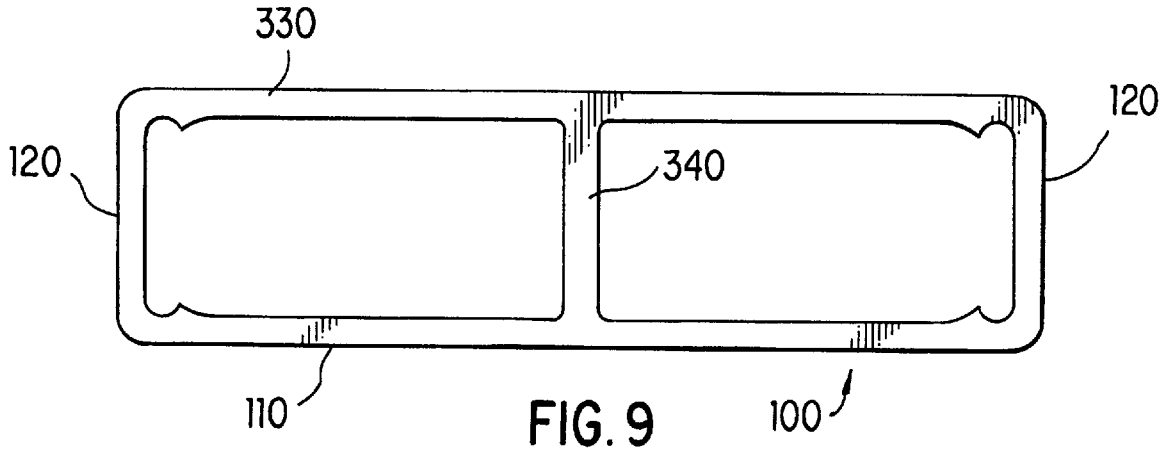
FIG. 9 depicts a front view of another embodiment of the invention.

FIG. 9 depicts a front view of another embodiment of the invention. In this embodiment, a handle 100 includes a continuous band of material 330, preferably selected from the group of rubbers and plastics, or other compounds having suitable characteristics including flexibility and resiliency. This band of material 330 is specially shaped such that it may serve as a handle 100. More particularly, the band of material includes two end portions 120, each of which are separated only by a second band of material 340. The second band of material 340 serves as a bridge across the continuous band of material 330. This second band of material 340 may be constructed from the same material as the continuous band of material 330, or it may be constructed from entirely different material. Suitable materials for the second band of material 340 would include rubbers, plastics, webbing, or rope-like material or other flexible materials. The second band of material 340 may provide the handle with additional strength and stability and it may simply prevent the continuous band of material 330 from departing too far from its desirable shape. The second band of material 340 is attached to the continuous band of material 330 in such a way that the two bands of material form two closed loops.

Figure 10:
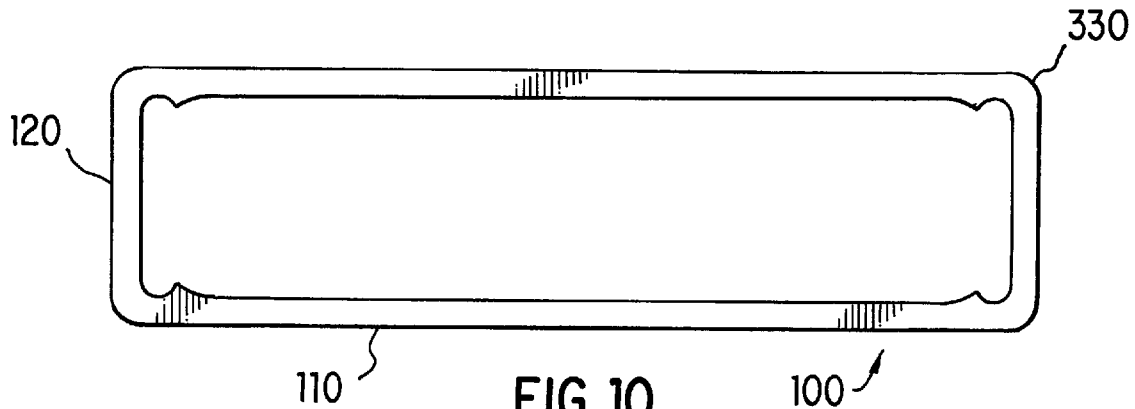
FIG. 10 depicts a front view of an embodiment similar to that shown in FIG. 9.

FIG. 10 depicts a front view of an embodiment similar to that shown in FIG. 9. A handle 100 is shown, including a continuous band of material 330, much like the embodiment depicted in FIG. 9. The handle shown in FIG. 10, however, lacks the second band of material depicted in the FIG. 9. In this way, the continuous band of material 330 forms a singular closed loop. This embodiment is of particular preference where the user desires to access the front side of a device as in the case of a CD-ROM, Digital Video Disc device or various other devices.

The embodiments depicted in FIGS. 9 and 10 are both preferable when a user anticipates desiring to remove or replace the handle 100 while the handle 100 is still installed upon a device. In this respect, the handles 100 depicted in FIG. 9 and 10 are constructed so that they may be removed or installed relatively quickly and easily. For purposes of the present disclosure and claims, the embodiments depicted in FIGS. 9 and 10 are considered to include a band portion 110, albeit of a different construction than previously described.

While the invention has been described and disclosed in various terms and certain embodiments, the scope of the invention is not intended to be, nor should it be deemed to be, limited thereby and such other modifications or embodiments as may be suggested by the teachings herein are particularly reserved especially as they fall within the breadth and scope of the claims here appended. Those skilled in the art will recognize that these and other variations are possible within the spirit and scope of the invention as defined in the following claims and their equivalents.

What is claimed is:

1. A handle for removing an electronic device from a device bay, said handle comprising a band portion, wherein said band portion is characteristically flexible and said band portion connects two end portions, each end portion being configured to detachably engage one of two separate mounting rails where each mounting rail is constructed to detachably engage an electronic device, wherein each end portion further comprises an interior edge defining an opening, wherein said opening is adapted to detachably connect to a complimentary portion of one of the mounting rails, and wherein the opening is generally square shaped and comprises:

an inside edge;

an outside edge;

a top edge, which includes a top flange extending away from the top edge; and a bottom edge, which includes a bottom flange extending away from the bottom edge.

2. The handle of claim 1, wherein the top and bottom flanges are positioned laterally along the top edge or bottom edge respectively, so that the mounting rail fits relatively snugly between the flanges and the outer edge.

* * * * *